US005510965A

United States Patent [19]

Teakell

[11] Patent Number: 5,510,965

[45] Date of Patent: Apr. 23, 1996

[54] ADJUSTABLE REFLECTOR/DIRECTOR FOR FLUORESCENT LIGHT FIXTURE

[75] Inventor: Joe F. Teakell, Arlington, Tex.

[73] Assignee: Plast-D-Fusers, Inc., Dallas, Tex.

[21] Appl. No.: 306,469

[22] Filed: Sep. 15, 1994

[51] Int. Cl.[6] ..... F21S 3/00

[52] U.S. Cl. ..... 362/223; 362/260; 362/278; 362/311; 362/320

[58] Field of Search ..... 362/223, 224, 362/248, 255, 256, 277, 278, 260, 293, 347, 311, 319, 320, 307

[56] References Cited

U.S. PATENT DOCUMENTS

| | | | |
|---|---|---|---|
| 3,805,053 | 4/1974 | Julinot | 240/51.11 |
| 4,186,431 | 1/1980 | Engel et al. | 362/223 |
| 4,280,170 | 7/1981 | Baldwin | 362/224 |
| 4,432,044 | 2/1984 | Lautzenheiser | 362/223 |
| 4,562,517 | 12/1985 | Pankin | 362/147 |
| 4,642,741 | 2/1987 | Cohn | 362/320 |
| 4,796,169 | 1/1989 | Shemitz | 362/282 |
| 4,833,575 | 5/1989 | Hamilton | 362/223 |
| 5,282,091 | 1/1994 | Grabowski | 362/311 |

*Primary Examiner*—Denise L. Gromada
*Assistant Examiner*—Y. Quach
*Attorney, Agent, or Firm*—Dennis T. Griggs

[57] ABSTRACT

Fluorescent tube lights have improved reflectors and light directors or dimming devices characterized by elongated light element protection tubes sleeved over the light elements and having a reflective and/or variable opacity surface formed thereon whereby the direction and intensity of light may be varied by rotating the protection tubes with respect to the light fixture. The light element protection tubes have a variable light blocking surface formed thereon or on a flexible plastic film insert which may be sleeved within the tubes to provide for improved projection of light direction and intensity. The light blocking surface is formed by an opaque portion and opposed variable opacity portions having a dot matrix pattern. The modified light reflecting and light blocking protection tubes may be otherwise conventional protection tubes which are usable in many applications including fluorescent light fixtures at office workstations.

18 Claims, 2 Drawing Sheets

ADJUSTABLE REFLECTOR/DIRECTOR FOR FLUORESCENT LIGHT FIXTURE

FIELD OF THE INVENTION

The present invention relates to a unique reflector and director or dimmer which is adapted for use with fluorescent light fixtures for reflecting and redirecting or dimming light emitted by fluorescent tube lights and the like.

1. Background of the Invention

Fluorescent lighting is in widespread use in commercial, office and residential lighting. The increasing cost of electricity in recent years has resulted in more effort to control the efficiency of fluorescent lighting by the development of certain types of reflectors and directors which focus or redirect light without replacement of the fluorescent fixture.

In many applications of fluorescent lighting it is desirable or required by law to provide a protective containment tube surrounding the tubular glass light element itself. For example, in food preparation and manufacturing facilities, fluorescent tube lights are required to be provided with an elongated, transparent containment or protective tube which is typically supported by the light fixture. This protective tube is usually formed of transparent plastic and may serve as an ideal support for a light reflector, director or dimmer element which may be supported by the protection tube, or the tube itself may be provided with an integral reflector or light directing and dimming means. In this way, existing fluorescent light fixtures may be modified to provide improved lighting without replacing the fixtures themselves.

2. Description of the Prior Art

It has been proposed to modify the transparent protection or containment tube for fluorescent light elements to include a pattern of opaque lines or markings which are adapted to control veiling reflections which can occur when an observer views an object having a given specularity. Since certain fluorescent light elements tend to provide non-uniform light emission throughout the length and diameter of the light element itself, the markings on the protective tube are adapted to be positioned so that the light source has an apparent uniform brightness. However, such modifications to fluorescent light fixture protection tubes do not solve the problem of reducing glare or reflections from fluorescent light sources, particularly in office applications wherein a worker viewing a computer screen, for example, may incur unwanted glare and reflections from such light sources.

Moreover, there are many applications of fluorescent light fixtures wherein increased reflectance, redirecting or focusing of the light toward a particular area or object is desired and wherein it is not desirable to substantially modify the light fixture by the installation of a reflector structure. Accordingly, suitable modification of the protection and containment tube provides an ideal and convenient manner for providing a reflector, director, diffuser or dimmer for fluorescent or tubular type lighting elements.

SUMMARY OF THE INVENTION

The present invention provides a unique reflector and director or dimmer device, particularly adapted for use with fluorescent light fixtures and the like.

In accordance with one important aspect of the present invention, a fluorescent light fixture is provided with a transparent light element protection and containment tube which is modified to include a light reflecting surface whereby improved focusing and reflecting of light emitted from a fluorescent light element is easily and economically provided.

In accordance with another important aspect of the invention, a fluorescent light fixture is easily modified to provide for directing, diffusing or dimming light with respect to a person or object by a unique light directing and dimming element which may be supported in or provided on a fluorescent light protection and containment tube. In particular, conventional plastic protection and containment tubes may be imprinted with a unique dot matrix pattern in accordance with the invention to provide a light directing and dimming feature. Alternatively, existing fluorescent light protection and containment tubes may be provided with a sleeve insert having the unique dot matrix light directing and dimming pattern formed thereon and which may be easily inserted in the protection tube.

Those skilled in the art will further appreciate the above-mentioned advantages and features of the invention together with other superior aspects thereof upon reading the detailed description which follows in conjunction with the drawing.

DESCRIPTION OF PREFERRED EMBODIMENTS

Figure 1:
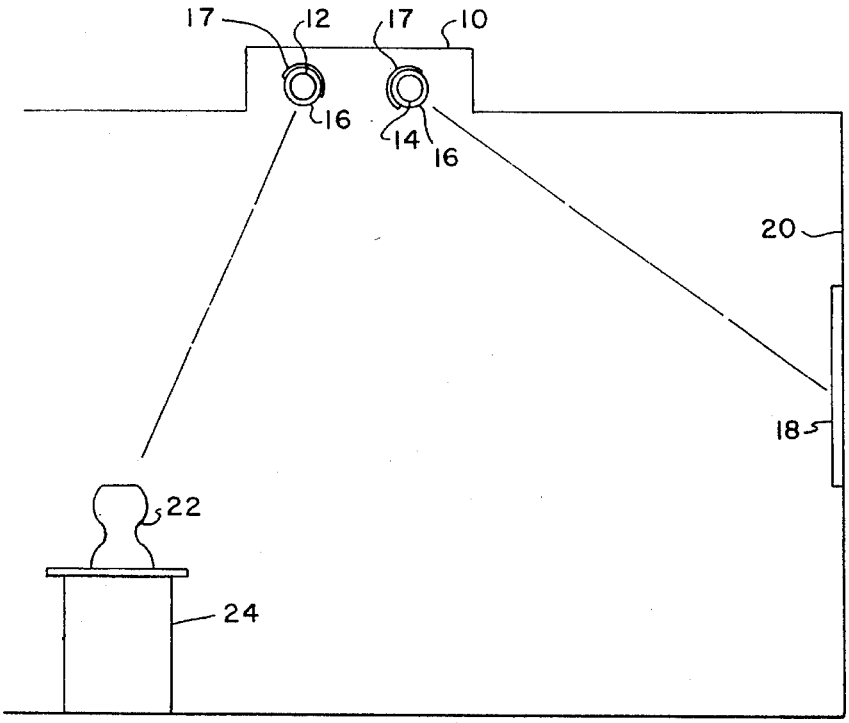
FIG. 1 is a side elevation of a room illustrating how the improved fluorescent light reflecting and directing device of the invention may be utilized.

In the description which follows like parts are marked throughout the specification and drawing with the same reference numerals, respectively. The drawing figures are not necessarily to scale in the interest of clarity and conciseness.

FIG. 1 illustrates a typical application of a recessed light fixture 10 for supporting elongated tubular light elements 12 and 14 which may comprise conventional fluorescent light elements, well known to those skilled in the art. The light elements 12 and 14 are each disposed within elongated transparent protection tubes 16, respectively, which are preferably formed of a transparent polycarbonate plastic, for example. The tubes 16 are of a type commercially available and are commonly used in fluorescent lighting applications to protect the glass lighting elements from breakage and to contain broken glass in the event an element becomes broken. In many applications of fluorescent lighting, it is desirable to be able to focus or direct the light onto a particular object such as an object 18 mounted on wall 20 and an object 22 supported on a table 24, for example. In accordance with the present invention, the light element protection tubes 16 are each provided with a suitable reflective surface 17 to assist in focusing the light emitted by the light elements 12 and 14, respectively. The reflective surfaces 17 will be further described herein.

Figure 2:
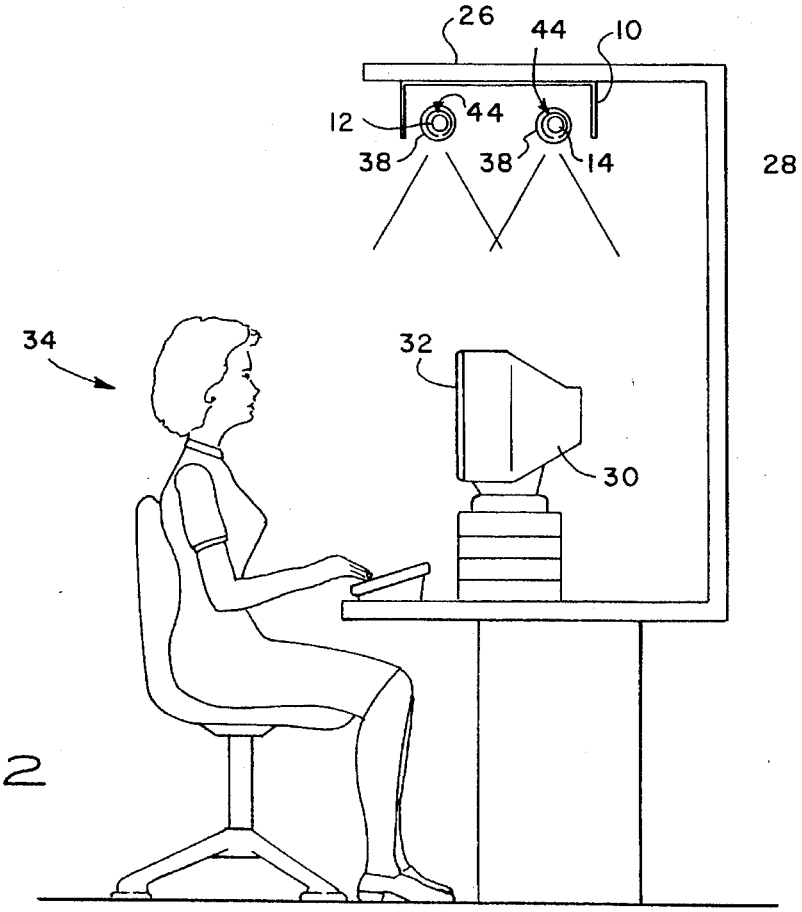
FIG. 2 is a side elevation of an office workstation showing a typical installation of a fluorescent light fixture with the improved light directing and dimming device of the present invention.

Referring now to FIG. 2, there is illustrated another typical application of a fluorescent light fixture 10 supported on a shelf or overhead element 26 forming part of an office workstation 28. The workstation 28 includes a conventional computer monitor 30 having a display screen 32 viewable by an operator 34. The position of the light fixture 10 in relation to the screen 32 and the operator 34 may cause glare or adverse reflections from the light elements 12 and 14 and the screen 32. However, in accordance with the present invention, the light elements 12 and 14 in the arrangement of FIG. 2 are disposed within suitable protection tubes 38 which have been modified in accordance with the invention as will be further described in detail hereinbelow. Suffice it to say that the examples given in FIGS. 1 and 2 of the fluorescent light fixture 10 are but two of a substantial number of applications of elongated tubular light sources, particularly fluorescent lighting, wherein it is desired to be able to focus the light energy being emitted by the light elements 12 and 14, as indicated in FIG. 1, or to redirect or dim the light being emitted by the elements 12 and 14, such as in the application of the light fixture 10 in FIG. 2.

Figure 3:
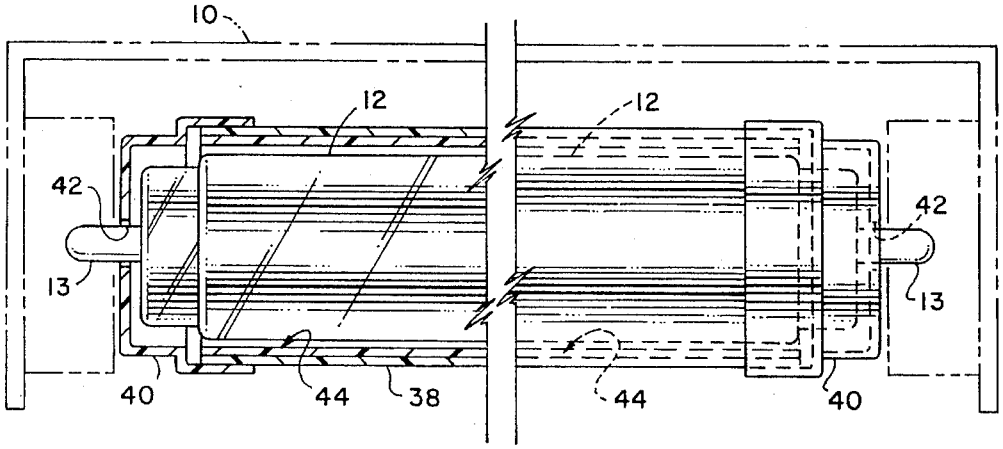
FIG. 3 is a side elevation partly sectioned, of a fluorescent light fixture having a protective tube together with a light reflecting and directing insert in accordance with the invention.

Referring now to FIG. 3, certain details of the exemplary fixture 10 and the light element 12 are illustrated by way of example. The glass tube light element 12 is characterized by opposed axially projecting contact and support pins 13 at opposite ends thereof, which pins are adapted to be supported in the light fixture 10 in a conventional manner. FIG. 3 shows one of the protection tubes 38 disposed substantially coaxial over the light element 12 and supported at its opposite ends by conventional cylindrical support caps 40. The support caps 40 each include a suitable elongated coaxial opening 42 for sleeving the caps over the pins 13, respectively. The protection tube 38 is snugly fitted at its opposite ends within each of the caps 40 but is rotatable relative to the caps so that the rotative position of the tube with respect to the fixture 10 may be adjusted along with any light reflecting or dimming surface disposed on or within the tube. As shown in FIG. 3, for example, the tube 38 is provided with an elongated flexible, sleeve-like insert 44, coextensive with the light element 12, and which will be described in further detail in conjunction with FIGS. 5 and 6.

Figure 4:
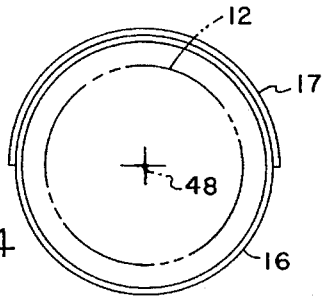
FIG. 4 is a transverse section view showing one arrangement of a reflector configuration for the light element protection tube.

FIG. 4 is a cross-section view on a larger scale of the light element 12 having one of the protection tubes 16 disposed thereover. The protection tube 16 is similar to the tube 38 and is provided with a thin film reflective surface 17 having an arc of approximately 180 degrees with respect to longitudinal axis 48 of the light element 12 and the tube 16. The reflective surface 17 may be formed of a suitable film which is adhesively secured to an outer or inner surface of the tube 16 and extending substantially over the length thereof. As illustrated in FIG. 4, the reflective film or surface 17 is disposed on the outer surface of the tube 16. The reflective surface 17 may be a silver or chrome-like coating on the tube 16 or a plastic film having a reflective metalized coating of aluminum or other suitable metal. One suitable material for the reflective surface 17 may comprise a sheet of Mylar® plastic film available from E. I. DuPont de Nemours and Company. Other compliant reflective materials or combinations of materials may be used as long as the reflective surface 17 has a reflectivity of about 70 percent to 100 percent. The reflective surface 17 may not be required to surround the tube 16 a full 180 degrees and the arc of the reflective surface 17 may be varied as desired. In all events, the tubes 16 may be easily rotatably adjusted about the axis 48 to direct light to desired locations as described in the exemplary application of the fixture 10 in conjunction with FIG. 1.

Figure 5:
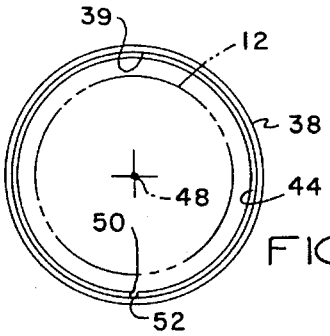
FIG. 5 is a transverse section view showing a light directing and dimming insert disposed in a protection tube.
Figure 6:
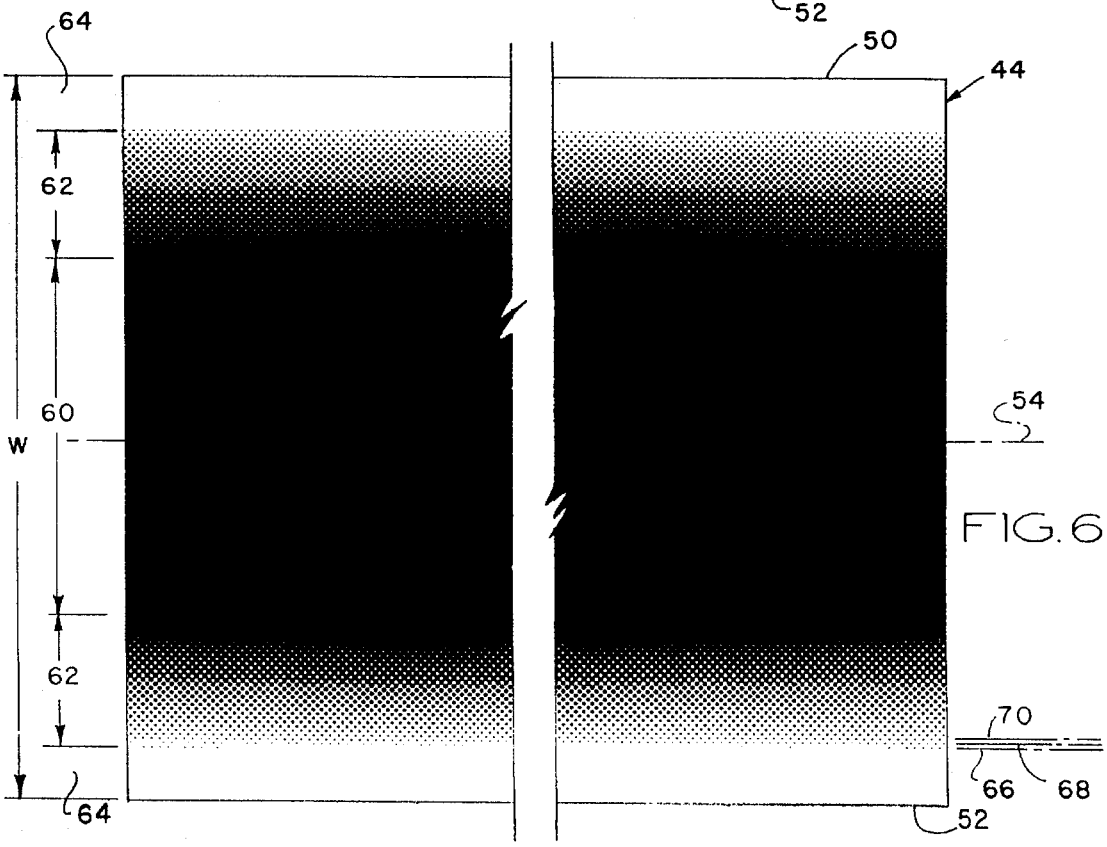
FIG. 6 is a plan view or planar development of an insert for a fluorescent light protection tube, or of the tube itself, showing a unique light directing and dimming pattern in accordance with the invention.

FIGS. 5 and 6 illustrate certain features of the embodiment of the invention described above in conjunction with FIG. 2. This embodiment may, however, also be used in certain applications for diffusing light, sometimes known as "wall washing". In FIG. 5, the exemplary light element 12 is shown disposed within the protection tube 38 which has the flexible insert 44 rolled and sleeved within the tube and pressed firmly against the inner surface 39, FIG. 5, of the tube 38 as a result of the elastic memory of the insert. The insert 44 is preferably formed of a suitable flexible polyester plastic film having a thickness of about 2 mils to 4 mils, for example. The polyester film is of a type which may be totally transparent but which is modified in accordance with the invention to have a unique light blocking and dimming pattern as illustrated in FIG. 6. The light blocking and dimming or diffusing pattern may be substantially non-reflective or highly reflective, as desired.

Referring to FIG. 6, the insert 44 is shown in a developed or plan view and is of generally elongated rectangular configuration, when developed, having opposed side edges 50 and 52 and a central axis 54. The light blocking and dimming pattern of the insert 44 is symmetrical about the axis 54 and is characterized by a substantially solid or opaque portion 60 which is about fifty percent of the width W of the insert 44. An opaque dot matrix pattern 62 is formed between the side edges of the opaque portion 60 and the side edges 50 and 52 on either side of the portion 60. Each of the dot matrix patterns 62 occupies a width of about eighteen to twenty percent of the width W of the insert 44. Between each dot matrix patterns 62 and the side edges 50 and 52 is a clear, or substantially transparent portion 64, each of which has a width of about five percent to seven percent of the overall width W of the insert 44.

The dot matrix patterns 62 have an opacity which varies from about 80 percent at the edges of the opaque portion 60 to about 40 percent at the edges of the clear portions 64 of the insert 44. This variable opacity is obtained by imprinting the insert 44 with a dot matrix pattern having from about 32 to 36 circular dots per lineal inch on centerlines 66, 68 and 70, for example, wherein every other line of dots is staggered with respect to the adjacent line of dots, as illustrated, and the diameter of the circular opaque dots increases from the outer edges of the portions 62 toward the inner edges or the edges of the totally opaque portion 60. The centerlines 66, 68 and 70 are spaced apart about 0.032 inches and are parallel to the axis 54. The opaque portion 60 and the dots of the matrix portions 62 may be of a non-reflective or light absorbing finish, such as black, or a mirror finish having a reflectivity of up to about 100 percent. The solid opaque portion 60 and variable opacity patterns 62 may be applied by hot stamping a suitable foil onto a clear polyester sheet to form the insert 44. The foil suitably bonds to the clear sheet and is then photographically etched to provide the dot pattern of the insert 44.

Those skilled in the art will appreciate that the tubes 38 may also be formed to have imprinted thereon the opaque portion 60 and variable opacity portions 62 in the pattern shown for the insert 44 in FIG. 6. However, by providing the plastic film insert 44 existing light fixtures may be easily retrofitted without requiring replacement of the protection tubes 38 or 16, as the case may be. With an insert 44 disposed in the tubes 38 as shown in FIGS. 2 and 5, the protective tubes 38 may be easily rotated about axis 48 to vary the direction and intensity of light being viewed by the operator 34 and being projected onto the screen 32 of the monitor 30, for example. A virtually infinitely variable degree of light intensity may be projected toward the screen 32 and the operator 34 to eliminate glare and undesirable reflections from the screen 32. Thanks to the unique insert 44 having the particular light blocking and dimming pattern described, existing fluorescent light fixtures with protective tubes 38 may be easily modified to control the light intensity and direction of projection of light. In fact with either of the modified tubes 16 or 38, direct or indirect lighting may be obtained by rotating the tubes to the desired position. Moreover, by substituting the tubes 38 for the tubes 16 in FIG. 1, with the inserts 44 disposed therein, improved light diffusion or "wall washing" lighting effects may be projected on the wall 20, for example.

The operation of the light reflecting and directing devices of the present invention is believed to be readily understandable from the foregoing description. Similarly, the fabrication of the light reflecting and directing devices may be carried out using substantially conventional techniques and from the above description. Those skilled in the art will further appreciate that certain modifications and substitutions may be made to the invention without departing from the scope and spirit of the appended claims.

What is claimed is:

1. A light control device for an elongated light source, such as a tubular fluorescent light element, said device comprising:

an elongated tube disposed around said light element and supported with respect to said light element for rotation substantially about a longitudinal axis of said tube, said tube including a variable light blocking surface disposed thereon and operable in response to rotation of said tube to change the intensity of light with respect to a particular point within range of light projection of said light source, said variable light blocking surface comprising an elongated opaque portion extending over a predetermined distance from opposite sides of a central axis of said surface and forming a predetermined part of a circle disposed about said longitudinal axis of said tube, and opposed portions of variable opacity being formed on said surface adjacent said opaque portion and radially spaced with respect to said longitudinal axis and arranged such that in response to rotation of said tube the direction and intensity of light emitted by said light source with respect to said point may be varied.

2. The device set forth in claim 1 wherein:

each portion of variable opacity is formed by a plurality of dots spaced from each other in a predetermined pattern.

3. The device set forth in claim 2 wherein:

the opacity of each pattern of dots varies from about 80 percent at an edge of said opaque portion to about 40 percent at a location on said surface which is circumferentially spaced with respect to the opaque edge portion.

4. The device set forth in claim 2 wherein:

said pattern of dots is formed of parallel lines of dots of about 32 to 36 dots per inch of line and said lines are spaced about 0.03 inches apart.

5. The device set forth in claim 1 wherein:

said device comprises a substantially flat plastic sheet having said variable light blocking surface formed thereon, said sheet being capable of being rolled and removably inserted in said tube.

6. The device set forth in claim 1 wherein:

said variable light blocking surface is formed on said tube.

7. The device set forth in claim 1 wherein:

said variable light blocking surface is imprinted on a sheet of flexible plastic and is of a substantially light absorbing color.

8. The device set forth in claim 1 wherein:

said variable light blocking surface is reflective.

9. The device set forth in claim 8 wherein:

the reflectivity of said variable light blocking surface is in a range of 70 percent to 100 percent.

10. A light control device for an elongated light source, such as a tubular fluorescent light element, said device comprising:

an elongated tube disposed around said light element and supported with respect to said light element for rotation substantially about a longitudinal axis of said tube, said tube including a variable light blocking surface disposed thereon and operable in response to rotation of said tube to change the intensity of light with respect to a particular object within range of light projection of said light source, said surface including an elongated opaque portion extending over a predetermined distance from opposite sides of a central axis of said surface and opposed portions of variable opacity being disposed adjacent to said opaque portion and radially spaced with respect to said longitudinal axis and arranged such that, in response to rotation of said tube, at least one of the direction and intensity of light emitted by said light source with respect to said object may be varied, and each portion of variable opacity is formed by a plurality of dots spaced from each other in a predetermined pattern.

11. The device set forth in claim 10 wherein:

the opacity of each pattern of dots varies from about 80 percent at an edge of the opaque portion to about 40 percent at a location on said surface which is circumferentially spaced with respect to the opaque edge portion.

12. The device set forth in claim 10 wherein:

said variable light blocking surface is disposed on a sheet of flexible plastic.

13. The device set forth in claim 10 wherein:

said variable light blocking surface is reflective.

14. The device set forth in claim 10 wherein:

said pattern of dots is formed of parallel lines of dots having variable sized dots numbering from about 32 to 36 dots per inch of line.

15. In a fluorescent light fixture having at least one elongated generally tubular fluorescent light element and an elongated tube disposed around said light element and supported on said light fixture for rotation with respect to said light element, a variable light blocking insert adapted to be sleeved within said tube and adapted to vary the direction and intensity of light emitted by said light element with respect to an object exposed to light projected from said light element, said insert including a variable light blocking surface thereon, said variable light blocking surface including an elongated opaque portion extending over a predetermined mined distance from opposite sides of a central axis of said surface and opposed portions of variable opacity being disposed adjacent to said opaque portion, respectively, and radially spaced with respect to said central axis and arranged such that, in response to rotation of said tube, at least one of the direction and intensity of light emitted by said light element with respect to said object may be varied.

16. The invention set forth in claim 15 wherein:

each portion of variable opacity is formed by a plurality of dots spaced apart from each other in a predetermined pattern.

17. The invention set forth in claim 16 wherein:

the opacity of said pattern of dots varies from about 80 percent at an edge of said opaque portion to about 40 percent at a location on said surface which is circumferentially spaced with respect to the opaque edge portion.

18. The invention set forth in claim 15 wherein:

said insert comprises a substantially flat plastic sheet having said variable light blocking surface disposed thereon, said sheet being capable of being elastically rolled and inserted in said tube.

* * * * *